US011834828B2

(12) United States Patent
Heesbeen

(10) Patent No.: US 11,834,828 B2
(45) Date of Patent: Dec. 5, 2023

(54) CEILING SUSPENSION SYSTEM HAVING A COUPLING BRACKET WITH RESILIENT RETAINING TABS

(71) Applicant: Saint-Gobain Acoustical Products International B.V., Harderwijk (NL)

(72) Inventor: Jan-Dirk Pieter Heesbeen, Hoogland (NL)

(73) Assignee: Saint-Gobain Acoustical Products International B.V., Harderwijk (NL)

( * ) Notice: Subject to any disclaimer, the term of this patent is extended or adjusted under 35 U.S.C. 154(b) by 0 days.

(21) Appl. No.: 17/625,126

(22) PCT Filed: Aug. 21, 2020

(86) PCT No.: PCT/EP2020/073529

§ 371 (c)(1),
(2) Date: Jan. 6, 2022

(87) PCT Pub. No.: WO2021/037742

PCT Pub. Date: Mar. 4, 2021

(65) Prior Publication Data

US 2022/0275642 A1 Sep. 1, 2022

(30) Foreign Application Priority Data

Aug. 23, 2019 (NL) ..... 2023698

(51) Int. Cl.
*E04B 9/16* (2006.01)
*E04B 9/06* (2006.01)

(52) U.S. Cl.
CPC ..... *E04B 9/16* (2013.01); *E04B 9/068* (2013.01)

(58) Field of Classification Search
CPC ..... E04B 9/068; E04B 9/16
See application file for complete search history.

(56) References Cited

U.S. PATENT DOCUMENTS 4,364,215 A * 12/1982 Gailey ..... E04B 9/065 52/506.08
4,560,126 A * 12/1985 Judkins ..... E04B 9/00 248/72

(Continued)

FOREIGN PATENT DOCUMENTS

JP S56-171920 U 12/1981
WO 2015/050448 A1 4/2015

*Primary Examiner* — James M Ference
(74) *Attorney, Agent, or Firm* — Hoffmann & Baron, LLP

(57) ABSTRACT

A ceiling suspension system includes a primary profile, a secondary profile, and a coupling bracket. The bracket includes a main body through which the primary profile can extend, two coupling legs that can lie at a first side of and couple with the secondary profile, and two retaining tabs which can lie at a second side opposite side of the secondary profile and enclosing the secondary profile form-fitting together with the primary profile and the coupling legs. The coupling bracket both in a non-installed and installed state, has its retaining tabs lie in the retaining position, where at least the retaining tabs of the coupling bracket are made resilient for being movable out of their retaining position towards a passing position in which the secondary profile is movable into or out of its form-fitting enclosing during coupling of the secondary profile with the coupling legs.

12 Claims, 17 Drawing Sheets

(56) References Cited

U.S. PATENT DOCUMENTS

| | | | | | |
|---|---|---|---|---|---|
| 4,723,749 | A * | 2/1988 | Carraro | E04B 9/18 | 52/39 |
| 4,726,165 | A * | 2/1988 | Brinsa | E04B 9/18 | 52/713 |
| 4,905,952 | A * | 3/1990 | Pinquist | E04B 9/16 | 24/537 |
| 5,203,818 | A * | 4/1993 | Kuiper | E04B 9/068 | 52/506.06 |
| 8,336,843 | B2 * | 12/2012 | Gulbrandsen | E04B 9/065 | 24/537 |
| 8,341,913 | B2 * | 1/2013 | Meres | E04B 9/241 | 52/489.1 |
| 8,695,296 | B2 * | 4/2014 | Bergman | E04B 9/24 | 52/39 |
| 9,482,001 | B2 * | 11/2016 | Sareyka | E04B 9/122 | |
| 9,745,746 | B2 * | 8/2017 | Heesbeen | E04B 9/24 | |
| 2010/0095627 | A1 * | 4/2010 | Meres | E04B 9/16 | 52/506.07 |
| 2014/0061417 | A1 * | 3/2014 | Maisch | E04B 9/20 | 29/897 |
| 2015/0308112 | A1 * | 10/2015 | Holdridge | E04B 9/0478 | 52/506.08 |
| 2015/0337532 | A1 * | 11/2015 | Cipriani | E04B 9/127 | 52/848 |
| 2016/0251855 | A1 * | 9/2016 | Heesbeen | E04B 9/24 | 52/506.05 |
| 2017/0044767 | A1 * | 2/2017 | Gloftis | E04B 9/225 | |
| 2022/0275642 | A1 * | 9/2022 | Heesbeen | E04B 9/16 | |

* cited by examiner

CEILING SUSPENSION SYSTEM HAVING A COUPLING BRACKET WITH RESILIENT RETAINING TABS

CROSS-REFERENCE TO RELATED APPLICATIONS

This application is the National Stage of International Application No. PCT/EP2020/073529, filed Aug. 21, 2020, which claims the benefit of Netherlands Application No. 2023698, filed Aug. 23, 2019, the contents of which is incorporated by reference herein.

FIELD OF THE INVENTION

The invention relates to a ceiling suspension system for a suspended ceiling, a coupling bracket for such a suspension system, and a method for the installation of such a suspension system.

BACKGROUND OF THE INVENTION

In a known embodiment such a ceiling suspension system comprises several primary profiles, several secondary profiles, several suspension elements and several coupling brackets. See for example WO 2015/050448. The primary profiles are suspended from a structure, in particular a ceiling, using a number of suspension elements. The primary profiles are suspended parallel to each other and if necessary partly extending in line with each other in a horizontal direction. The secondary profiles are coupled to the primary profiles using coupling brackets which are configured to allow the secondary profiles to run underneath the primary profiles. The secondary profiles are fitted extending in a second substantially horizontal direction perpendicular to the first direction. The secondary profiles are configured to support ceiling plates. The coupling brackets are installed around the primary profile with a main body, in which coupling legs extend downwards on both sides of the primary profile to attach to the secondary profile.

The coupling brackets are configured for the provision of a relatively rigid connection between the primary profile and the secondary profile, wherein the primary profile and the secondary profile extend at an angle of 90 degrees to each other. The secondary profiles run underneath the primary profiles. This known suspension system is for example suited for concealed suspension and/or suspension of strips of ceiling plates. Here, concealed means that after the installation of the ceiling plates, the ceiling plates substantially adjoin each other in both directions. The undersides of the secondary profiles in such a concealed suspended ceiling are no longer visible or only partly visible. This known system is also suited for other ceiling types, like ones with groove joints, plank systems, timber grills, etc. For suspension in strips, the secondary profile can also remain visible between the ceiling plates.

The primary profiles have openings to receive the ends of the suspension elements for the suspension of the primary profiles. The secondary profiles have openings to receive the ends of the coupling legs of the coupling brackets. The primary and secondary profile are provided here with identical sets of multi-purpose openings. Thus they can serve as primary and secondary profile. The openings in the primary profile and the secondary profile used here can however also be different in design and be provided in different positions in relation to the relevant profile.

Although this known ceiling suspension system is already quite efficient and economic, it is noted that the installation of a suspended ceiling with it still leaves to be improved. During such installation, the brackets must be manually placed over the primary profiles and then the secondary profiles need to be manually coupled to the brackets, after which plastic deformations of retaining tabs of each of the brackets need to take place in order to lock the secondary profiles in position thereto with the aimed relative rigid connection. The placing, coupling and locking is a time-consuming and heavy task for an installer, particularly because he needs to do this manually for large numbers of profiles and brackets. Furthermore all this needs to be done above one's head. Furthermore, it is noted that the placing, coupling and locking is also time-consuming and heavy because the bracket is made out of relative thick-walled steel which has a high resistance against any type of deformation.

JP-S-56.171.920-U shows another example of a ceiling system that makes use of primary and secondary profiles and brackets. There also a plastic deformation of retaining tabs of the brackets is foreseen, bringing along similar disadvantages as mentioned above in that the placing, coupling and locking is a time-consuming and heavy task for an installer, particularly because he needs to do this manually and above one's head for large numbers of profiles and brackets.

SUMMARY OF THE INVENTION

The present invention aims to overcome those disadvantages at least partly or to provide a usable alternative. In particular the present invention aims to provide a ceiling suspension system which enables simpler installation.

This aim is achieved by the ceiling suspension system according to the present invention. This system comprises a primary profile which, in an installed state, extends in a first direction, one or more suspension elements for the suspension of the primary profile, a secondary profile which, in an installed state, extends in a second direction perpendicular to the first direction, below the primary profile and which is configured to support ceiling plates, and a coupling bracket for coupling the primary profile with the secondary profile. The coupling bracket comprises a main body that defines a space through which, in the installed state, the primary profile extends, two coupling legs which extend from the main body on both sides of the space while, in the installed state, lying at a first side of the secondary profile and coupling with the secondary profile, and two retaining tabs which extend from the main body on both sides of the space while, in a retaining position in the installed state, lying at a second side situated opposite the first side of the secondary profile and enclosing the secondary profile form-fitting together with the primary profile and the coupling legs. According to the inventive thought the coupling bracket both in a non-installed state as well as in said installed state, has its retaining tabs lie in the retaining position, wherein at least the retaining tabs of the coupling bracket are made resilient elastically deformable for being movable out of their retaining position towards a passing position in which the secondary profile is movable into or out of its form-fitting enclosing during coupling of the secondary profile with the coupling legs, and for the resilient elastically deformable retaining tabs to then spring back towards their retaining position.

Advantageously a further improved user-friendly, easy installation of a suspended ceiling has now been made possible. During this installation, the brackets can be easily placed over the primary profiles and then the secondary profiles can be easily coupled to the brackets, during which the resilient retaining tabs of each of the brackets automatically get pushed out of the way to thereafter automatically spring back to their retaining positions while simultaneously locking the secondary profiles in position thereto. The placing, coupling and locking now has become a truly fast and light task for an installer. He can easily do this manually for large numbers of profiles and brackets. Furthermore, it is noted that the placing, coupling and locking can also be fast and light because the bracket can be made at least partly and preferably entirely out of thin-walled resilient plate material.

It is now advantageously possible for the secondary profile to be firstly coupled in for example a slanted position to the coupling legs, and then secondly to be moved towards its installed state while remaining coupled with the coupling legs and while pushing the resilient retaining tabs to move out of their retaining position towards their passing position such that the secondary profile is able to pass the retaining tabs, after which the resilient retaining tabs automatically and immediately spring back towards their retaining position in which they automatically and immediately cause the secondary profile to get enclosed form-fitting by the retaining tabs together with the primary profile and the coupling legs.

The bracket preferably can be made out of one resilient plate-shaped material that is folded into a three-dimensional shape while forming the main body, the coupling legs and the retaining tabs.

In a preferred embodiment, the coupling bracket may be made entirely out of spring steel. It is however also possible to have it made out of any other suitable material or combination of materials, like for example plastic, that is/are able to provide it with the aimed resilient characteristics.

In a further preferred embodiment, the resilient elastically deformable retaining tabs may extend slanted downwards relative to the second direction and outwards away from the primary profile. This specific slanted positioning has the effect that the secondary profile, during coupling to the bracket, shall exert its upwards directed pushing force onto the free outer edges of the tabs. This has the advantage that a lower coupling force needs to be exerted onto the secondary profile in order to be able to temporarily move the tabs out of the way towards their passing positions in order to be able to move the secondary profile fully towards and into its installed state.

In addition thereto, the resilient retaining tabs may be provided with a narrowing or rejuvenation at its corners in order to improve the securing and to be able to take up some tolerance.

In addition thereto or in the alternative, transitions between the tabs and the main body, for example folding lines when made out of a same piece of plate material, then may be positioned as close as possible, preferably less than 2 millimetres, above the height at which the horizontal part of the primary profile lies. This is possible because the downwards slanted orientation of the tabs still gives them enough space to get moved out of the way during coupling of the secondary profile.

In another preferred embodiment, the coupling bracket may further comprise a positioning element which is configured to cooperate with the primary profile to position the coupling bracket longitudinally in the first direction on the primary profile, wherein also the positioning element of the coupling bracket can be made resilient elastically deformable for being movable out of a starting position towards a passing position when the coupling bracket gets placed around the primary profile in the installed state, and for the positioning element to then spring back towards its starting position. The resilient positioning element helps to further simplify the installation. Owing to its provision, the brackets can more easily be placed over the primary profiles. In contrast to the state of art, where when a maneuvering of the rigid main body and of the rigid positioning element that extended through the space delimited by the main body, needed to be performed, it is now possible to have the positioning element automatically get pushed out of the way to thereafter automatically spring back to its starting position. Also a sliding of the bracket in the longitudinal direction over the primary profile in order to seek an aimed longitudinal position has become easier. As soon as this position is found, the positioning element shall automatically be able to lock itself in the longitudinal first direction onto the primary profile.

In addition, the resilient elastically deformable positioning element may extend angled upwards through the space. This causes it to have to flex less in order to get out of the way when getting forced to move towards its passing position when the bracket gets placed in a downward movement over the primary profile.

In another preferred embodiment, the main body that defines the space has a V-shaped cross-section which is arranged upside down in the installed state, wherein a point of the V-shaped cross section has a U-shaped cross section which is also arranged upside down in the installed state and which is complementary to an upper tubular part of the primary profile, wherein at least the U-shaped cross section of the main body is made resilient for being movable out of a starting position towards a passing position when the coupling bracket gets arranged around the primary profile in the installed state, and for the U-shaped cross section of the main body to then spring back towards its starting position. The resilient U-shaped cross section helps to further simplify the installation. Owing to its provision, the brackets can more easily be placed over upper tubular parts of the primary profiles. Also a sliding of the bracket in the longitudinal direction over the primary profile in order to seek an aimed longitudinal position has become easier. As soon as this position is found, side walls of the U-shaped cross section shall automatically exert a clamping force onto the tubular part of the primary profile. This shall help to obtain a rigid connection between the coupling bracket and the primary profile, which in turn shall make it easier for the secondary profile to get coupled to the bracket and moved towards its installed state relative to the primary profile and the coupling bracket.

In addition, inwardly projecting locking rills may be provided at angled transitions between the U- and V-shaped cross sections, which locking rills extend in the first direction and are configured for enclosing the upper tubular part of the primary profile form-fitting together with the U-shaped cross section. Thus an even more reliable and rigid connection can be obtained between the primary profile and the coupling bracket.

In another preferred embodiment, the coupling legs may extend vertically down from lower ends of the main body. In particular the coupling legs then may be spaced from each other over a distance that is substantially equal to the width of a lower horizontal part of the primary profile. Also the coupling legs then preferably are made resilient for being movable out of a starting position towards a passing position when the coupling bracket gets arranged around the primary profile in the installed state. The resilient coupling legs help to further simplify the installation. Owing to its provision, the brackets can more easily be placed over lower horizontal parts of the primary profiles. As soon as this is done, the legs shall automatically delimit the horizontal part of the primary profile. This shall help to obtain a rigid connection between the coupling bracket and the primary profile, which in turn shall make it easier for the secondary profile to get coupled to the bracket and moved towards its installed state relative to the primary profile and the coupling bracket.

In addition thereto, transitions between the legs and the main body, for example folding lines when made out of a same piece of plate material, then may be positioned as close as possible, preferably less than 2 millimetres, above the height at which the horizontal part of the primary profile lies. This has the advantage that the connection between the bracket and the primary profile then shall deform less when loaded.

Further preferred embodiments are described herein.

The invention also relates to a coupling bracket for coupling a primary profile of a ceiling suspension system with a secondary profile, and to a method for installing a ceiling suspension system.

BRIEF DESCRIPTION OF THE DRAWINGS

Further features and benefits of the invention will be explained hereinafter in the description of an embodiment of the ceiling suspension system, with reference to the accompanying drawings, in which.

DETAILED DESCRIPTION OF THE INVENTION

Figure 1A:
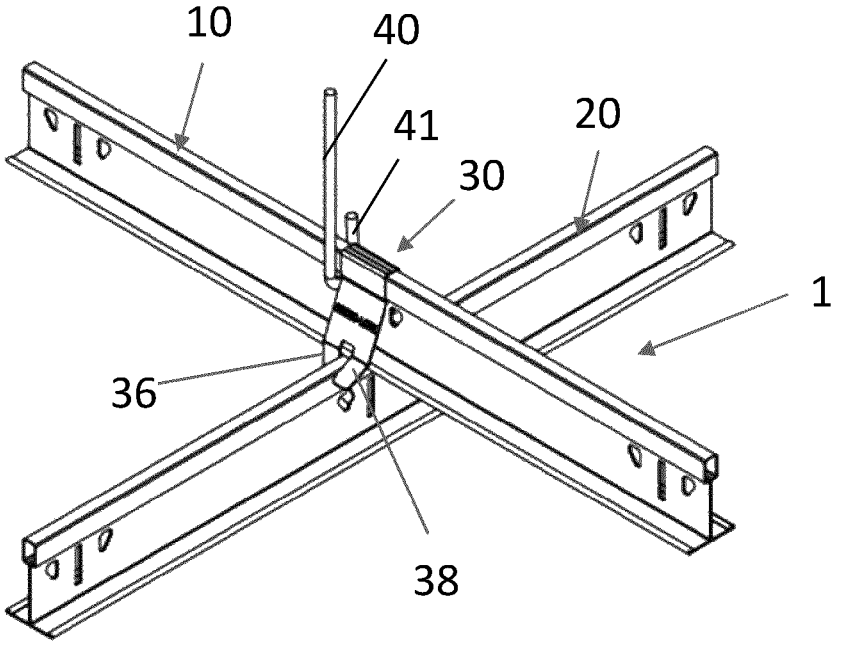
FIGS. 1*a-d* show perspective views seen from above resp. below of part of a suspension system according to the invention in the coupled state.
Figure 1B:
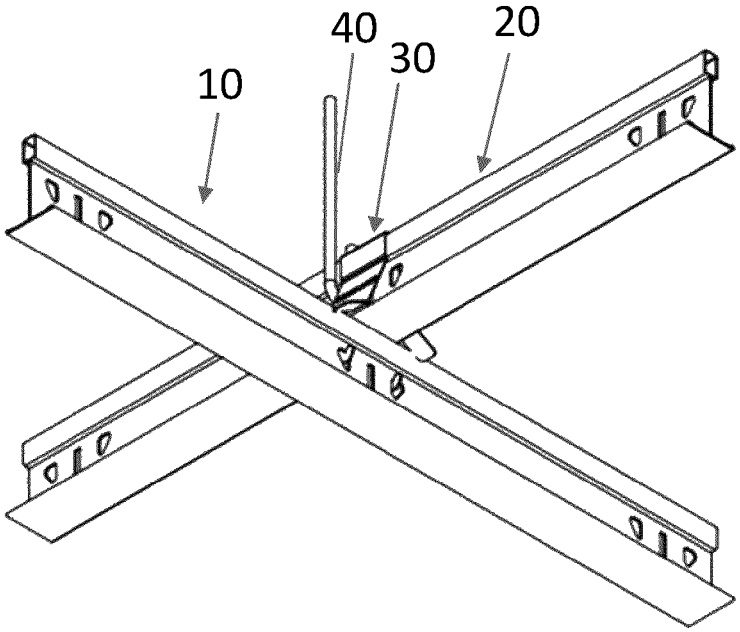
Figure 1C:
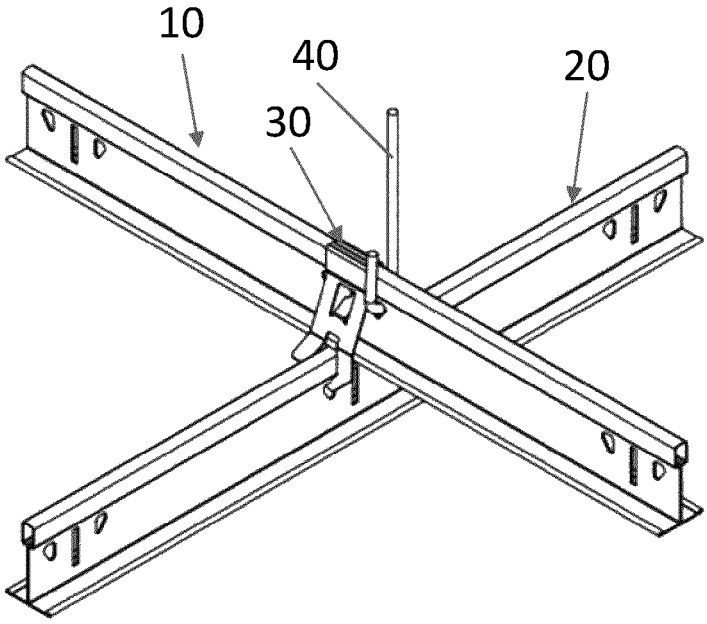
Figure 1D:
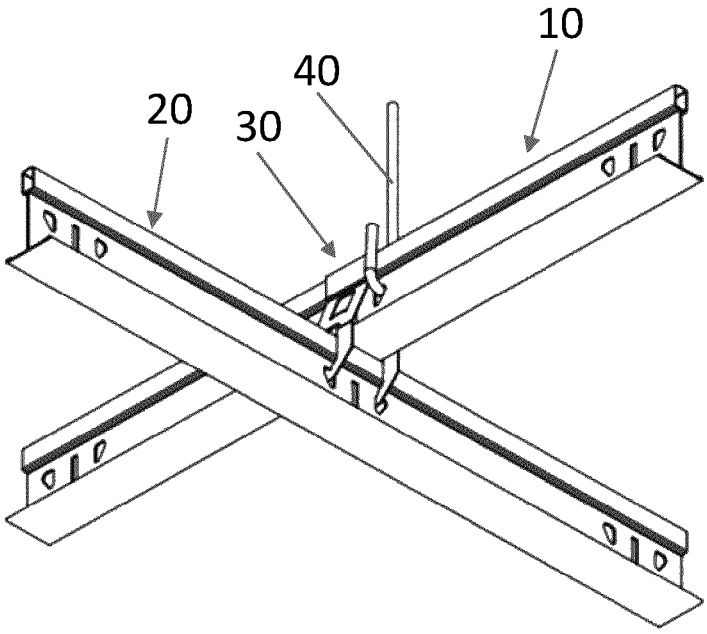
Figure 2:
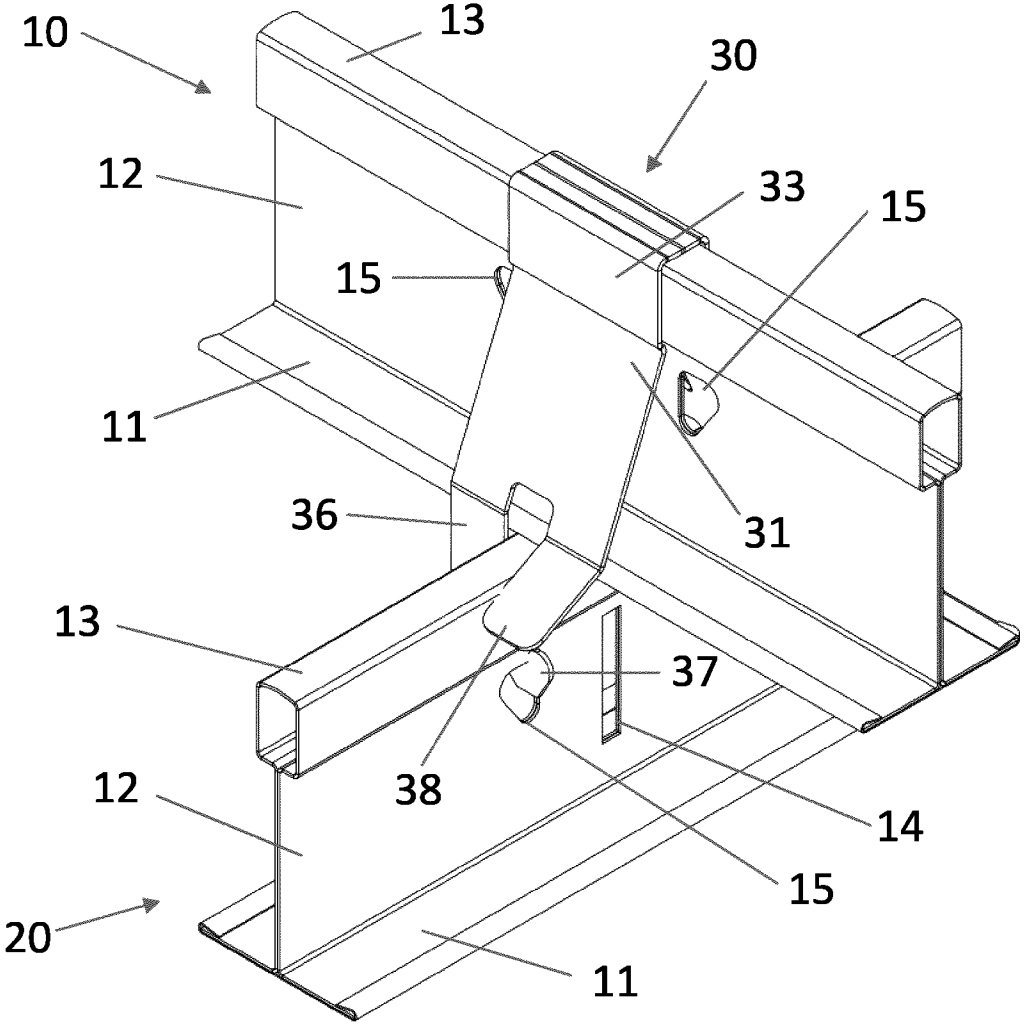
FIGS. 2-4 show enlarged partial views of FIG. 1.
Figure 3:
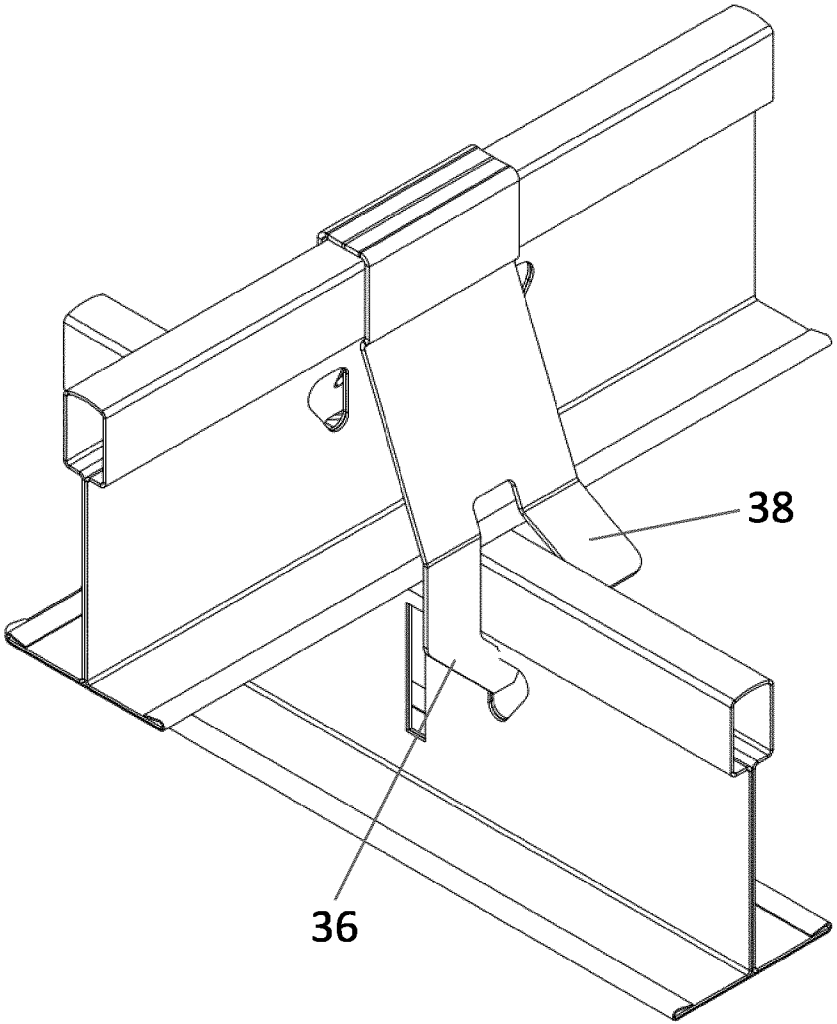
Figure 4:
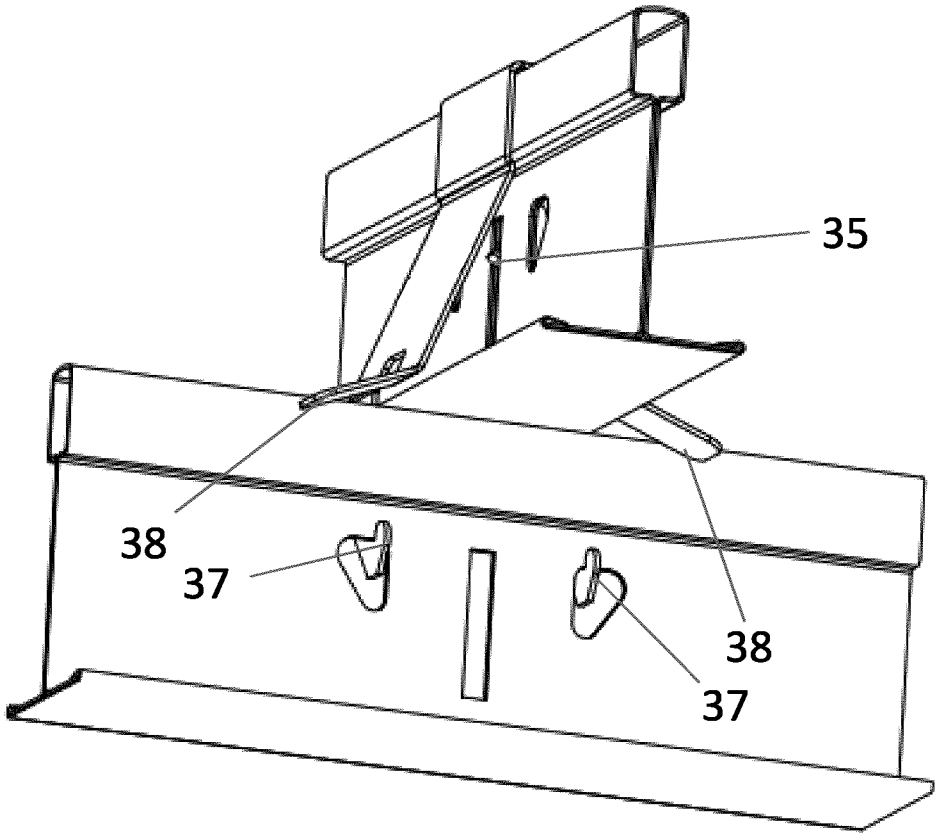

In FIG. 1-7 the ceiling suspension system is indicated in its entirety by the reference number 1. The illustrated suspension system 1 is in particular but not exclusively configured to be used for a concealed suspended ceiling, in which the ceiling plates adjoin very closely so that the undersides of the profiles are invisible or only slightly visible after the installation of the ceiling plates, or for a strip ceiling system in which profiles extending in one direction are visible after the installation of the ceiling plates. The suspension system 1 can however also be applied for other types of ceiling systems.

Suspension system 1 comprises primary profiles 10 which extend parallel to each other in a first horizontal direction, secondary profiles 20 which run underneath the primary profiles 10 in a second horizontal direction which is substantially perpendicular to the first direction. The primary profiles 10 and secondary profiles 20 are coupled to each other by coupling brackets 30 which are configured to couple the profiles rigidly to each other at an angle of 90 degrees.

During assembly a number of primary profiles 10 are suspended using suspension elements 40 from a structure, generally a ceiling, at a desired height. The coupling brackets 30 are then used to couple the secondary profile 20 to the primary profile 10. After the coupling of the secondary profiles 20 a grid of primary and secondary profiles is created which is suitable for bearing the ceiling plates. The ceiling plates (not illustrated) are supported by the secondary profiles 20.

The primary profile 10 and the secondary profile 20 are formed here by identical profiles, as illustrated in FIG. 1-7.

Each profile 10, 20 has a substantially T-shaped cross-section which in the installed assembled state is arranged upside down; i.e. the profile 10, 20 has a lower horizontal part 11, configured to support ceiling plates, an intermediate vertical part 12 extending in a vertical direction from a centre of the lower horizontal part 11 and an upper tubular part 13 provided at an upper end of the vertical part 12 opposite to the horizontal part 11. The tubular part 13 provides rigidity to the profile 10,20.

In the vertical part 12 an openings combination is provided with a central opening 14 and two side openings 15. The central opening 14 is designed as a vertical slot, whilst the two side openings 15 are designed as triangular openings of which a first edge extends in a substantially vertical direction and a second edge extends in a substantially horizontal direction. The vertically extending first edges of the side openings 15 are the edges of the side openings situated closest to the central opening 14. The openings 14 and 15 can also have other shapes.

The distance between the two side openings 15, in particular the distance between the two first edges thereof, corresponds substantially to the width dimension of the horizontal part 11 of the profile 10, 20.

Figure 8:
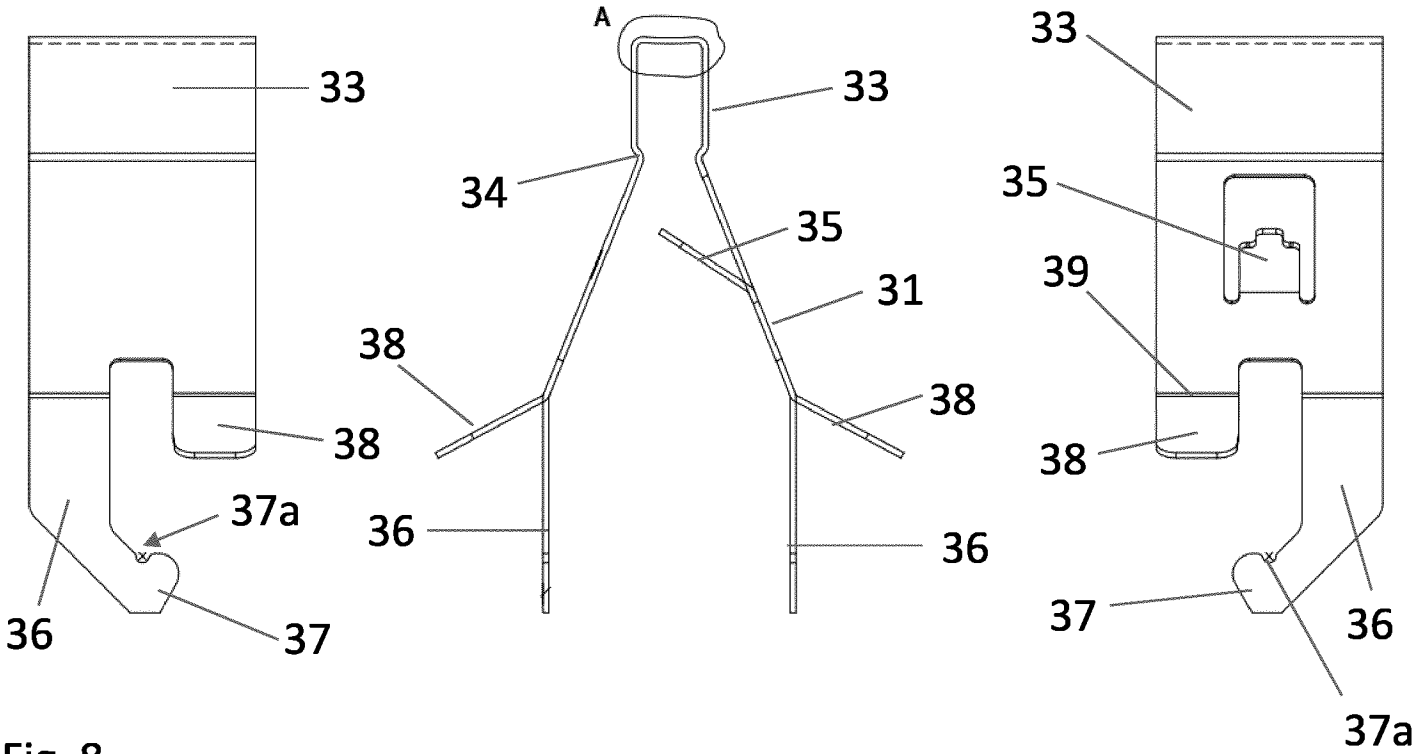
FIG. 8 shows a left side, front and right side view of the coupling bracket in FIGS. 1-7.
Figure 9:
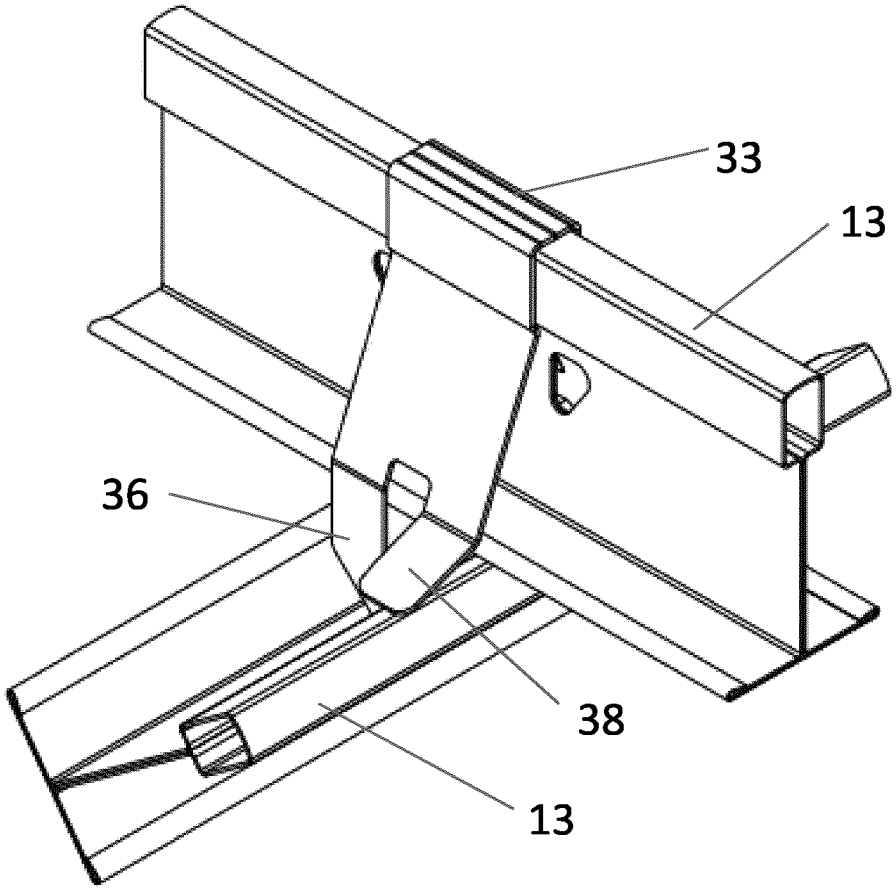
FIGS. 9-11 show views corresponding to FIGS. 2-4 during starting of coupling of the secondary profile to the assembly of primary profile and bracket.
Figure 10:
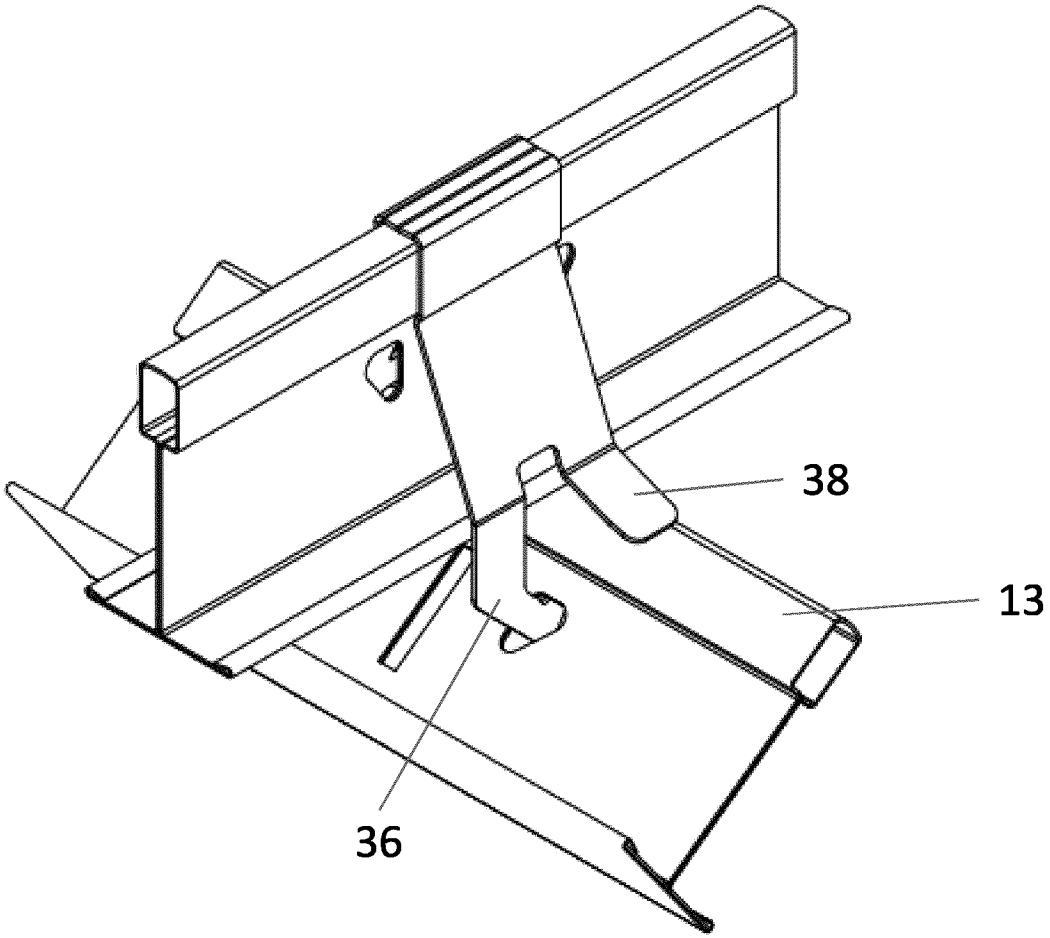
Figure 11:
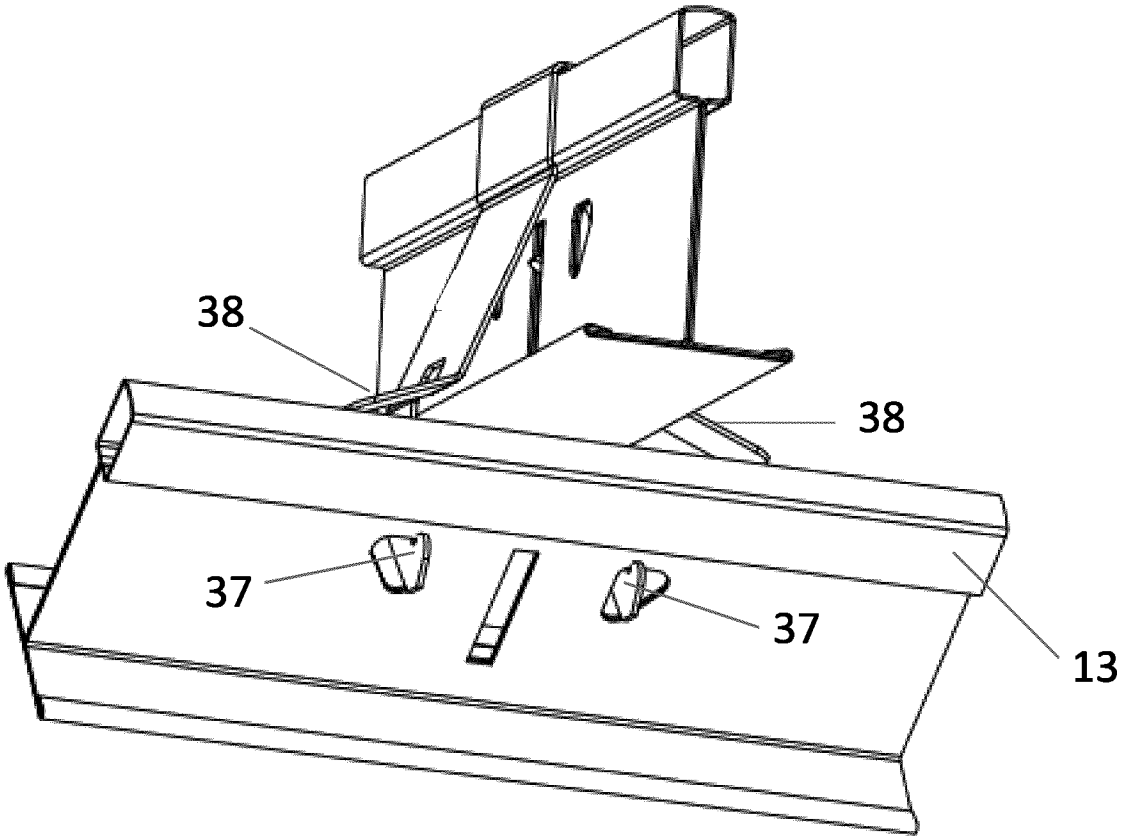
Figure 12:
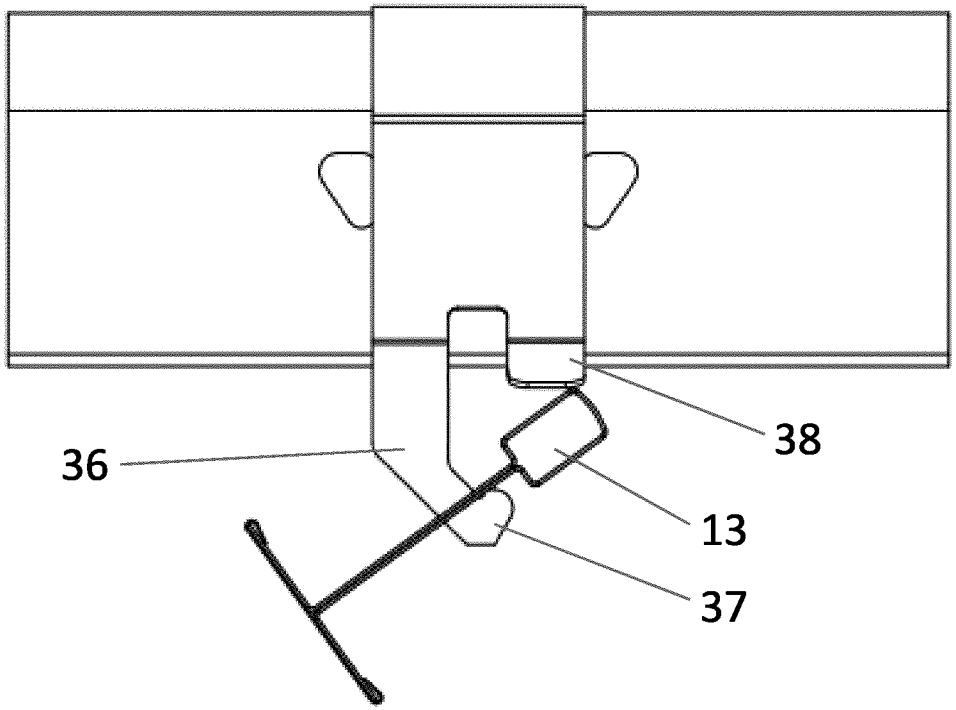
FIG. 12 shows a front view of FIG. 9.
Figure 13:
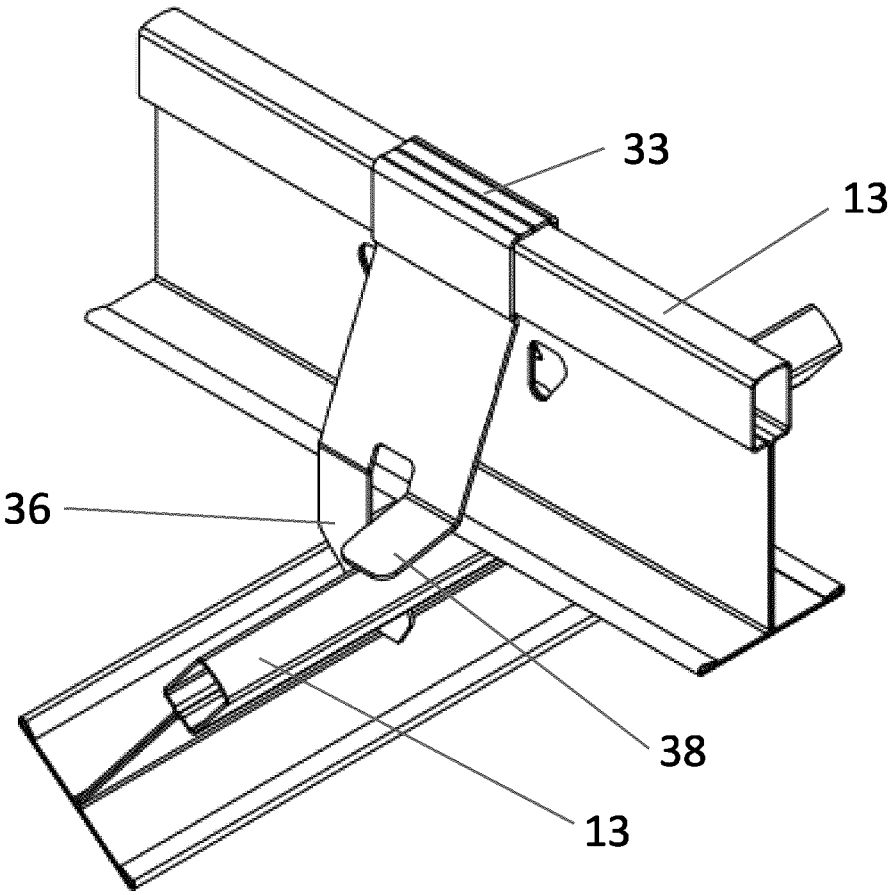
FIGS. 13-15 show views corresponding to FIGS. 2-4 during an intermediate phase of coupling of the secondary profile to the assembly of primary profile and bracket.
Figure 14:
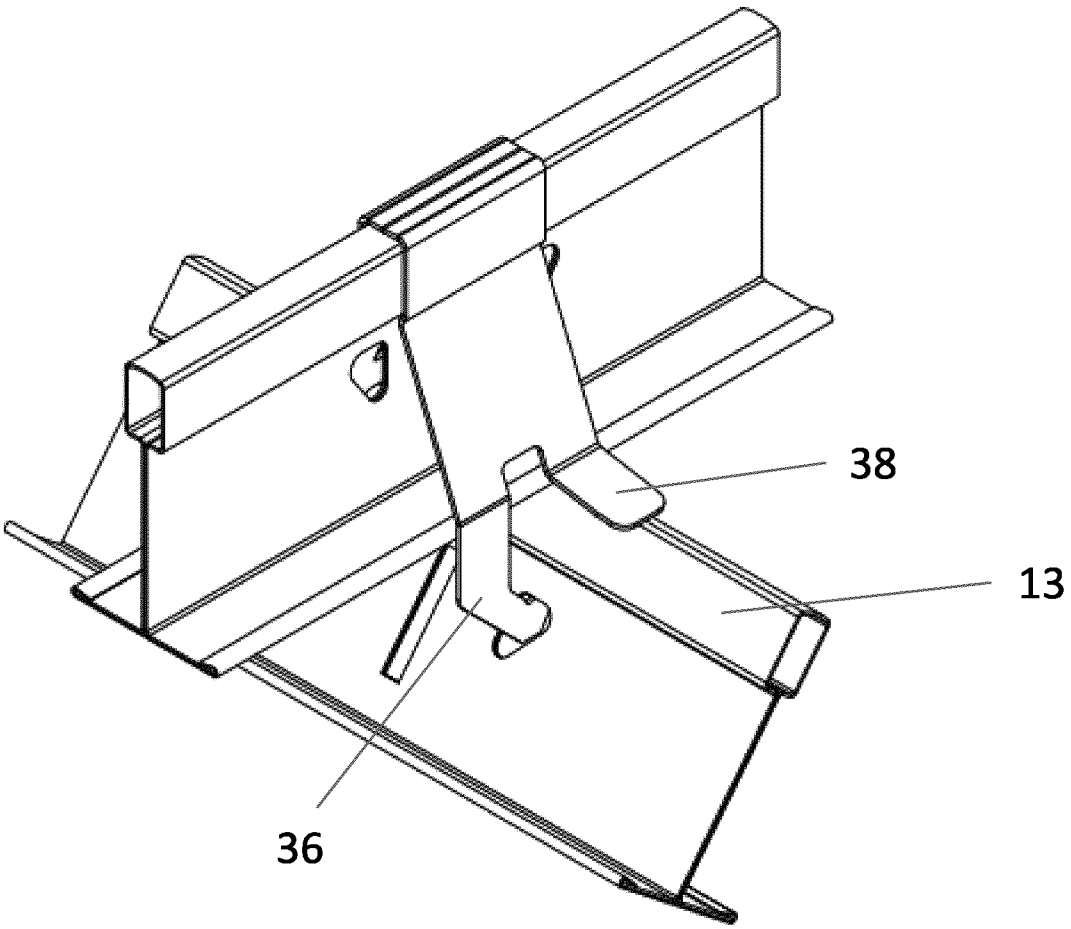
Figure 15:
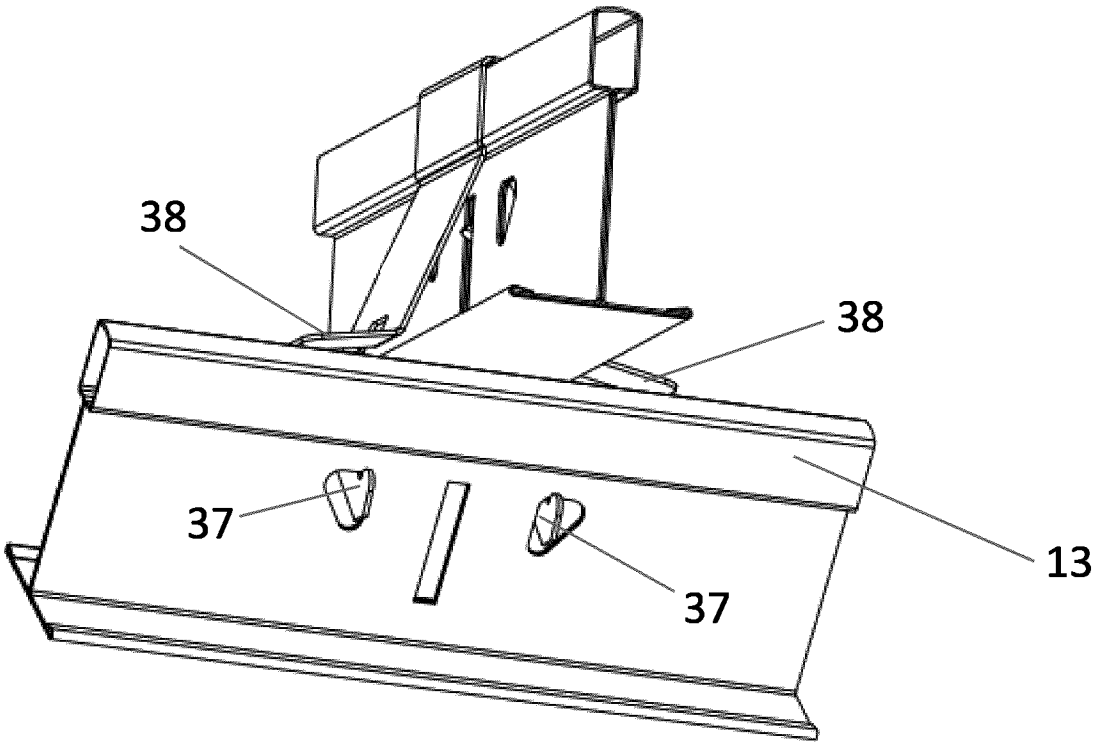
Figure 16:
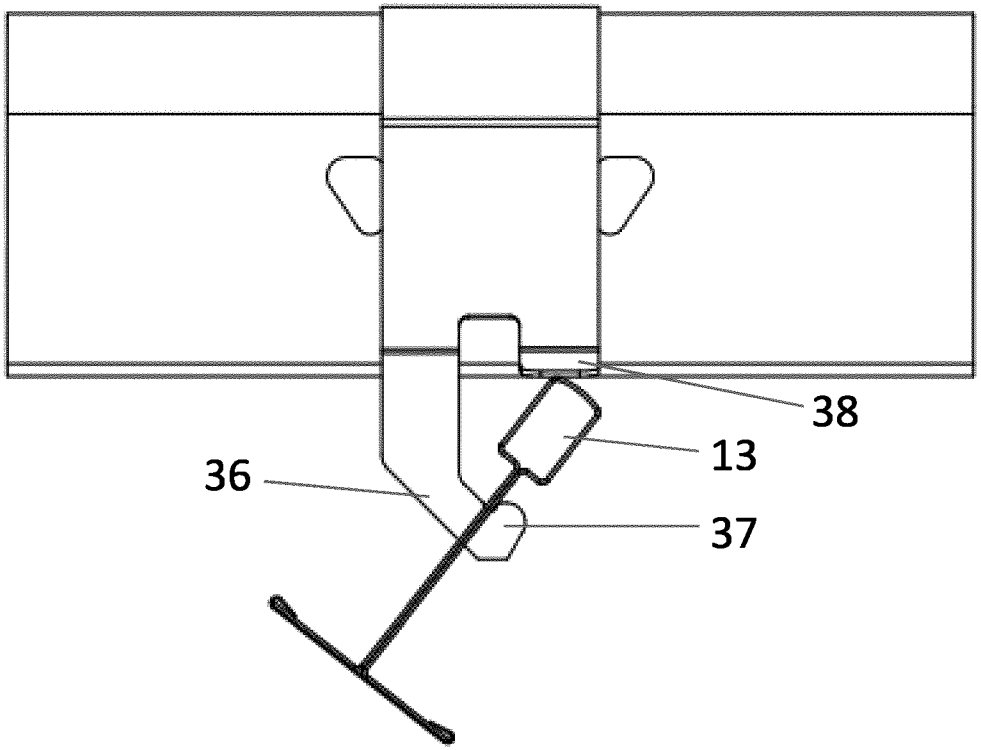
FIG. 16 shows a front view of FIG. 13.

The coupling bracket 30 is made out of resilient elastically deformable spring steel plate material which is folded into shape while still being configured for a rigid connection of the primary profile 10 and the secondary profile 20 at an angle of 90 degrees. See also FIG. 8.

Figure 5:
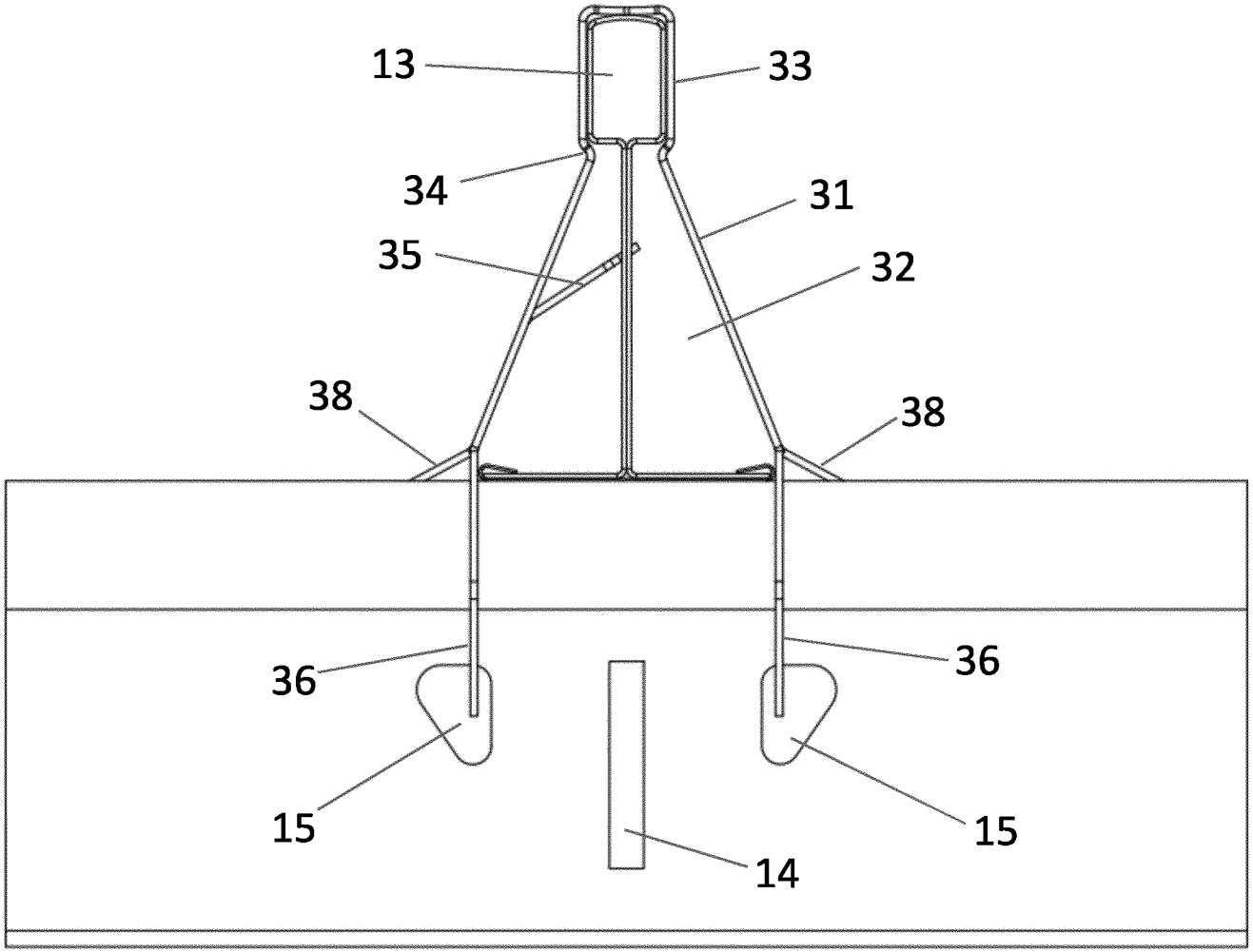
FIGS. 5-7 show a left side, front and right side view of FIG. 2.
Figure 6:
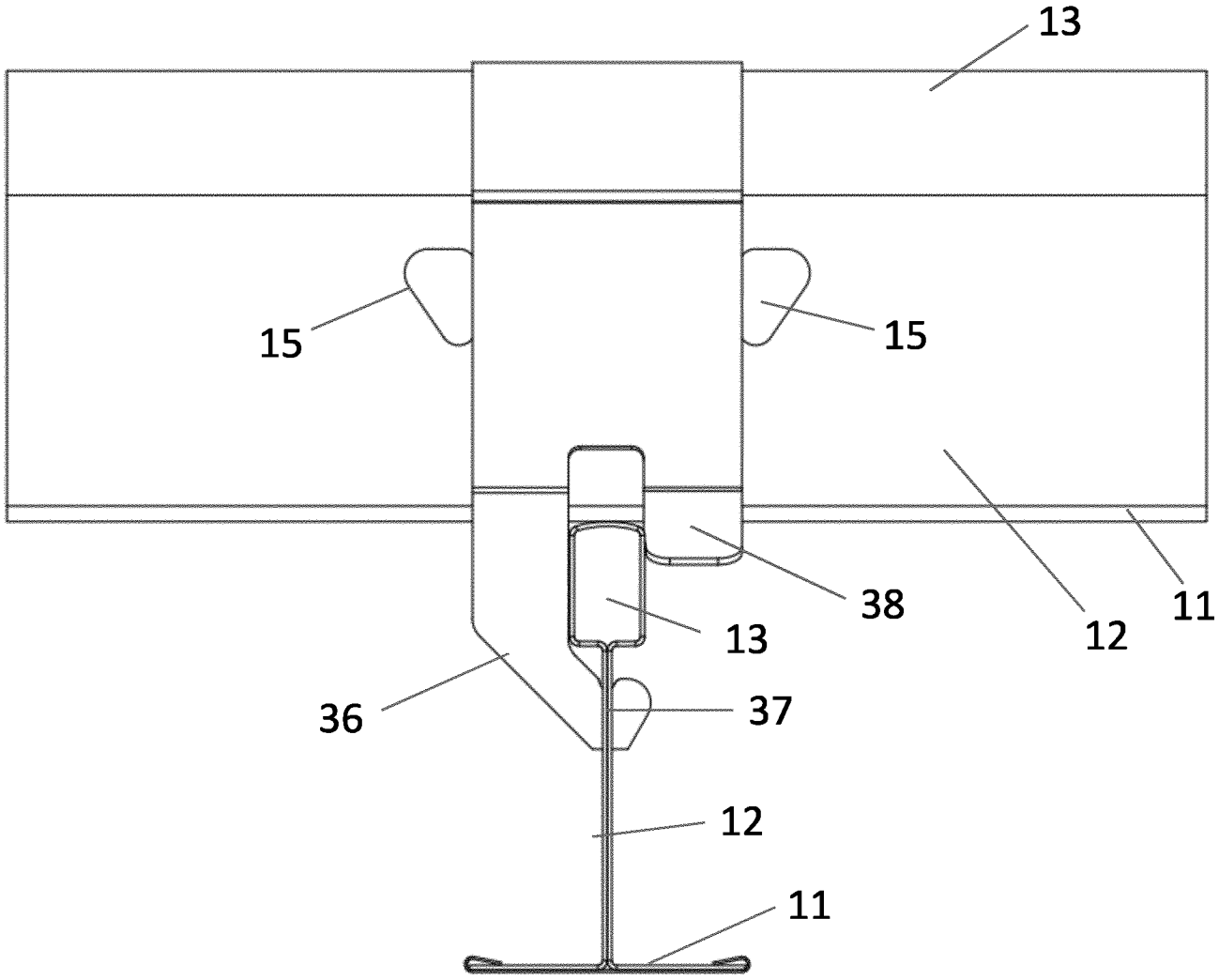
Figure 7:
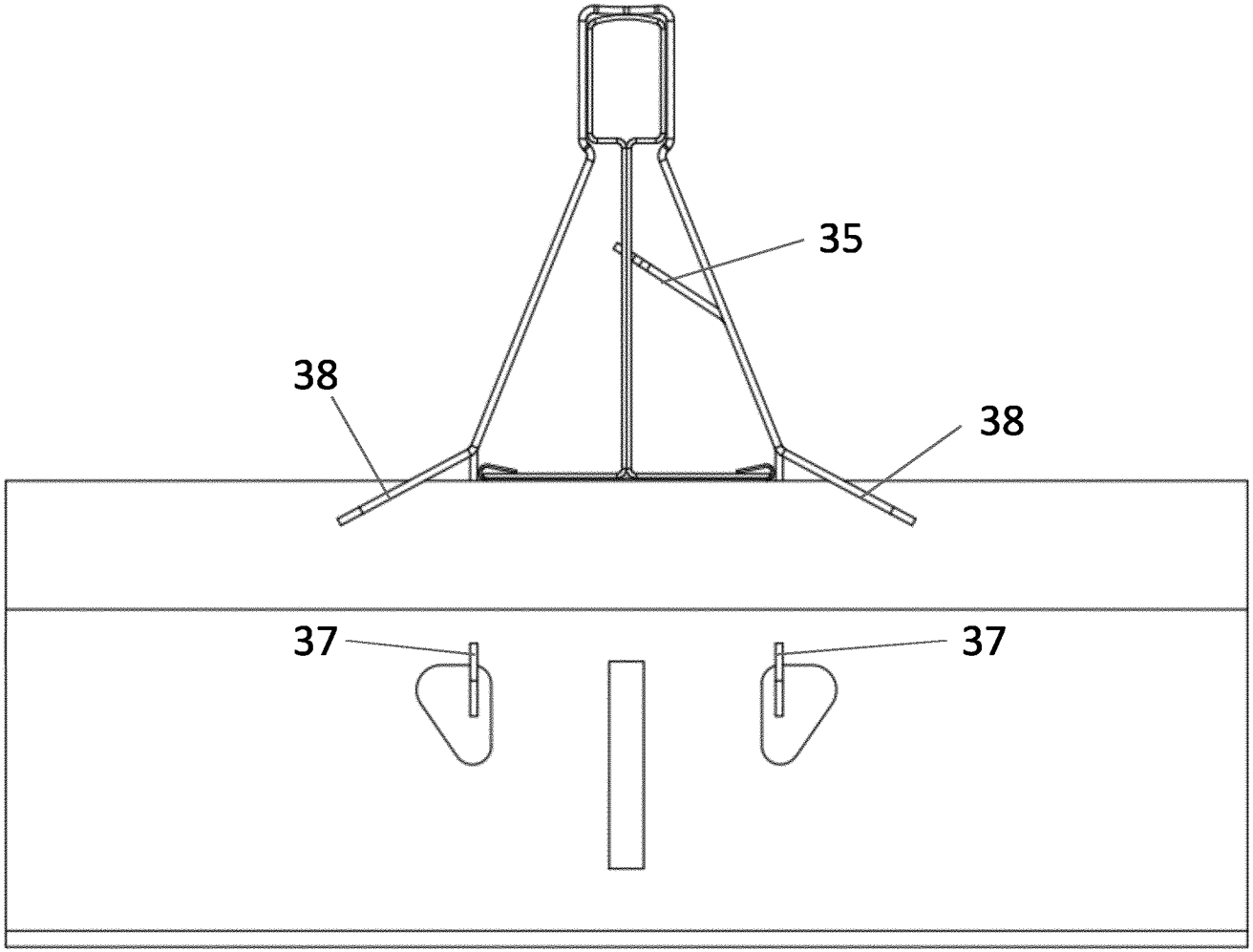

The coupling bracket 30 comprises a resilient elastically deformable main body 31 which comprises V-shaped side walls to create a space 32 for the receipt of the primary profile 10 (see FIG. 5). The point of the V-shape has a U-shaped part 33 which is configured to fit the tubular part 13 of the primary profile 10. At folding transitions between the U-shaped part 33 and the V-shaped side walls of the main body 31, locking rills 34 are provided which extend in the first direction x along the entire width of the bracket 30, and which project inwardly such that they grip somewhat underneath the tubular part 13 in the installed state. As a result of these locking rills 34 a strong form-fitting enclosure is obtained when installing the coupling bracket 30 on the primary profile 10. As soon as the locking rills 34 have reached the lower side of the tubular part 13, they shall spring inwards towards each other owing to the elastic characteristics of the resilient spring steel plate material the bracket 30 is made out. This shall cause side walls of the U-shaped part 33 to smash against side walls of the tubular part 13, which not only shall give the user the feeling of a snap connection when placing the coupling bracket 30 on the primary profile 10, but which shall also produce an audible click sound, which gives the user an additional check that this part of the coupling process has been completed in a correct manner.

Further, the main body 31 is provided with a resilient elastically deformable positioning element 35 which extends slanted upwards into the space 32. The position and shape of the positioning element 35 is such that the coupling bracket 30 gets locked in the longitudinal first direction x on the primary profile 10 when the end of the positioning element 35 resiliently clicks in the central opening 14 of the primary profile 10. If necessary the bracket 30 can be slid in the longitudinal first direction x along the primary profile 10 until the positioning element 35 has gotten to lie in front of the central opening 14. As soon as the positioning element 35 has reached the central opening 14, it shall spring inwards with its free end into this central opening 14 owing to the elastic characteristics of the resilient spring steel plate material the bracket 30 is made out. This shall again give the user the feeling of a snap connection and may also produce an audible click sound, which gives the user additional checks that also this part of the coupling process has been completed in a correct manner.

In this way the coupling bracket 30 can be placed in a simple and reliable manner in the desired longitudinal position on the primary profile 10, as a result of which a correct distance between secondary profiles 20 can be guaranteed. This is relevant since this distance must correspond to dimensions of ceiling plates which are to be installed on the suspension system 1.

On the underside of the main body 31 two resilient elastically deformable coupling legs 36 extend vertically downwards which are configured with lower hook-shaped leg ends 37 that are to be hooked into the side openings 15 of the secondary profile 20. For that reason, the lower leg ends 37 of the coupling legs 36 extend horizontally sideways in the first direction x, whereby the leg ends 37 at their upper sides are provided with recesses 37*a* (see FIG. 8) which during attachment to the secondary profile 20 cooperates with the two second horizontal edges of the respective side openings 15 therein. During attachment both vertically extending upper parts of the coupling legs 36 are placed on one side of the secondary profile 20.

It is noted that because the distance between the two side openings 15 substantially corresponds to the width dimension of the horizontal part 11 of the primary profile 10, the horizontal part 11 is placed between the two coupling legs 36, abutting them, as a result of which the rigidity of the coupling is further enhanced.

On the underside of the main body 31 two resilient elastically deformable retaining tabs 38 extend slanted downwards relative to the second direction y and outwards away from the primary profile 10. The tabs are made resilient by themselves as well as around a fold line 39 via which they are attached to the main body 31. The tabs 38 are configured to extend from the main body 31 along both sides of the horizontal part 11 of the primary profile 10 to there lie in a retaining position. In the installed state as shown in FIG. 1-7, the tabs 38 in their retaining position, lie at an opposing side of the secondary profile 20 compared to the side where the legs 36 are placed. The secondary profile 20, and in particular the upper tubular part 13 thereof, then is held form-fitting by the tabs 38 on a right side, by the vertical parts of the legs 36 on a left side, by the horizontal leg ends 37 on a lower side, and by the horizontal part 11 of the primary profile 10 on an upper side.

According to the inventive thought the coupling bracket 30 in a non-installed non-loaded state also has its retaining tabs 38 lie in the above described retaining position. The retaining tabs 38 can be temporarily flexed out of the way for having the secondary profile 20 pass by them. The subsequent phases of coupling are shown respectively in FIGS. 9-12, 13-16 and 2-7.

After the secondary profile 20 has been hooked in a tilted position with its side openings 15 onto the ends 37 of the coupling legs 36, the secondary profile 20 can be manually rotated to its installed state. During this rotation an upper corner of the tubular part 13 of the secondary profile 20 shall abut against the free outer edges of the tabs 38. This is shown in FIG. 9-12. A further manual rotation of the secondary profile 20 then shall force the tabs 38 to flex upwardly and thus move out of the way towards a passing position, which is shown in FIG. 13-16, until the tubular part 13 of the secondary profile 20 gets to abut against the vertical parts of the coupling legs 36. As soon as this position is reached, the tabs 38 shall spring back to their starting retaining positions in which they enclose one side of the tubular part 13 of the secondary profile 20. This is shown in FIG. 1-7. As a result a rigid connection is obtained between the primary profile 10 and the secondary profile 20. A manually to be induced plastic deformation of the tabs 38 advantageously is not needed for this. The biasing force of the flexed tabs 38 together with their curved edge corners shall cause the rotation of the secondary profile 20 towards its installed state to be accelerated at the end. This shall cause the tubular part 13 of the secondary profile 20 to smash against the vertical parts of the legs 36, which not only shall give the user the feeling of a snap connection when rotating the secondary profile 20 to its coupled installed state, but which shall also produce an audible click sound, which gives the user an additional check that this part of the coupling process also has been completed in a correct manner.

Besides the embodiment shown, numerous variants are possible. For example the dimensions and shapes of the various parts may be changed. Hereinabove an embodiment of the suspension system is described comprising identical primary and secondary profiles i.e. a profile can be used both as a primary profile and a secondary profile. As a logical consequence the primary profile and the secondary profile have an identical openings combination for the receipt of the suspension element and the receipt of the positioning element and the receipt of the coupling legs of the coupling bracket. In an alternative embodiment, the suspension system may however also comprise different profiles as primary and secondary profiles, in which profiles even non-identical openings combinations can be used for these functions. It is remarked that where the directions "horizontal" and "vertical" are used these are applicable to the various components in the installed state. It will be evident to person skilled in the art that the various parts and components may extend in other directions in the non-installed state; in that case, the directions "horizontal" and "vertical" describe a relative relationship. It is noted that in the "installed state" the system can also be mounted under an angle such that it is also suited to a certain extent for non-horizontal ceilings, like for example oblique ones.

Thus according to the present invention a ceiling suspension system is provided with an improved coupling bracket that owing to its resilient characteristics in combination with its specific shaping, positioning, orientating of the respective parts thereof, is well able to make the coupling of large amounts of brackets to primary profiles and, thereafter, the coupling of secondary profiles to those sub-assemblies of primary profiles and brackets not only much easier and lighter, but also safer compared to the state of the art.

The invention claimed is:

1. A ceiling suspension system for a suspended ceiling, comprising:

a primary profile which, in an installed state, extends in a first direction;

one or more suspension elements for suspension of the primary profile;

a secondary profile which, in an installed state, extends in a second direction perpendicular to the first direction, below the primary profile and which is configured to support ceiling plates; and a coupling bracket for coupling the primary profile with the secondary profile, wherein the coupling bracket comprises:

a main body that defines a space through which, in the installed state, the primary profile extends;

two coupling legs which extend from the main body on opposing sides of the space while, in the installed state, lying at a first side of the secondary profile and coupling with the secondary profile; and two retaining tabs which extend from the main body on the opposing sides of the space while, in a retaining position in the installed state, lying at a second side situated opposite the first side of the secondary profile and enclosing the secondary profile form-fitting together with the primary profile and the coupling legs, wherein the coupling bracket both in a non-installed state as well as in said installed state, has the two retaining tabs lying in the retaining position, wherein at least the retaining tabs of the coupling bracket are made resilient elastically deformable for being movable out of their retaining position towards a passing position in which the secondary profile is movable into or out of the form-fitting enclosing during coupling of the secondary profile with the coupling legs, and for the resilient elastically deformable retaining tabs to then spring back towards their retaining position, and wherein the resilient elastically deformable retaining tabs extend slanted downwards relative to the second direction and outwards away from the primary profile, for the secondary profile to firstly be coupled to the coupling legs in a tilted position, and then secondly be tilted towards the installed state while having an upper part of the secondary profile push the slanted downwards extending resilient elastically deformable retaining tabs to move out of the retaining position towards the passing position by resilient elastic deformation such that the upper part of the secondary profile is able to pass the retaining tabs, after which the retaining tabs spring back towards the retaining position causing the upper part of the secondary profile to get enclosed form-fitting by the retaining tabs together with the primary profile and the coupling legs.

2. The ceiling suspension system according to claim 1, wherein the coupling bracket further comprises a positioning element which is configured to cooperate with the primary profile to position the coupling bracket longitudinally in the first direction on the primary profile, and wherein also the positioning element of the coupling bracket is made resilient elastically deformable for being movable out of a starting position towards a passing position when the coupling bracket gets placed around the primary profile in the installed state, and for the positioning element to then spring back towards the starting position.

3. The ceiling suspension system according to claim 2, wherein the resilient elastically deformable positioning element extends angled upwards through the space.

4. The ceiling suspension system according to claim 1, wherein the main body that defines the space has a V-shaped cross-section which is arranged upside down in the installed state, wherein a point of the V-shaped cross section has a U-shaped cross section which is also arranged upside down in the installed state and which is complementary to an upper tubular part of the primary profile, and wherein at least the U-shaped cross section of the main body is made resilient elastically deformable for being movable out of a starting position towards a passing position when the coupling bracket gets arranged around the primary profile in the installed state, and for the U-shaped cross section of the main body to then spring back towards the starting position.

5. The ceiling suspension system according to claim 4, wherein the retaining tabs extend slanted downwards from angled transitions with lower ends of the V-shaped cross section.

6. The ceiling suspension system according to claim 4, wherein the coupling legs extend vertically down from angled transitions with lower ends of the V-shaped cross section.

7. The ceiling suspension system according to claim 1, wherein the coupling bracket is made out of spring steel.

8. The ceiling suspension system according to claim 1, wherein transitions between the slanted downwards extending resilient elastically deformable retaining tabs and the main body are positioned less than 2 millimetres above a height at which, in the installed state, a lower part of the primary profile lies.

9. A ceiling suspension system for a suspended ceiling, comprising:

a primary profile which, in an installed state, extends in a first direction;

one or more suspension elements for suspension of the primary profile;

a secondary profile which, in an installed state, extends in a second direction perpendicular to the first direction, below the primary profile and which is configured to support ceiling plates; and a coupling bracket for coupling the primary profile with the secondary profile, wherein the coupling bracket comprises:

a main body that defines a space through which, in the installed state, the primary profile extends;

two coupling legs which extend from the main body on opposing sides of the space while, in the installed state, lying at a first side of the secondary profile and coupling with the secondary profile; and two retaining tabs which extend from the main body on the opposing sides of the space while, in a retaining position in the installed state, lying at a second side situated opposite the first side of the secondary profile and enclosing the secondary profile form-fitting together with the primary profile and the coupling legs, wherein the coupling bracket both in a non-installed state as well as in said installed state, has the two retaining tabs lie in the retaining position, and wherein at least the retaining tabs of the coupling bracket are made resilient elastically deformable for being movable out of the retaining position towards a passing position in which the secondary profile is movable into or out of the form-fitting enclosing during coupling of the secondary profile with the coupling legs, and for the resilient elastically deformable retaining tabs to then spring back towards the retaining position, wherein the main body that defines the space has a V-shaped cross-section which is arranged upside down in the installed state, wherein a point of the V-shaped cross section has a U-shaped cross section which is also arranged upside down in the installed state and which is complementary to an upper tubular part of the primary profile, wherein at least the U-shaped cross section of the main body is made resilient elastically deformable for being movable out of a starting position towards a passing position when the coupling bracket gets arranged around the primary profile in the installed state, and for the U-shaped cross section of the main body to then spring back towards the starting position, and wherein inwardly projecting locking rills are provided at angled transitions between the U-shaped cross-section and the V-shaped cross sections, wherein the inwardly projecting locking rills extend in the first direction and are configured for enclosing the upper tubular part of the primary profile form-fitting together with the U-shaped cross section.

10. A coupling bracket for coupling a primary profile with a secondary profile, comprising:

a main body that defines a space through which, in an installed state, the primary profile extends;

two coupling legs which extend from the main body on opposing sides of the space while, in the installed state, lying at a first side of the secondary profile and coupling with the secondary profile; and two retaining tabs which extend from the main body on opposing sides of the space while, in a retaining position in the installed state, lying at a second side situated opposite the first side of the secondary profile and enclosing the secondary profile form-fitting together with the primary profile and the coupling legs, wherein the coupling bracket both in a non-installed state as well as in said installed state, has the two retaining tabs lying in the retaining position, wherein the retaining tabs are made resilient elastically deformable for being movable out of the retaining position towards a passing position in which the secondary profile is movable into or out of the form-fitting enclosing during coupling of the secondary profile with the coupling legs, and for the resilient elastically deformable retaining tabs to then spring back towards their retaining position, and wherein the resilient elastically deformable retaining tabs extend slanted downwards relative to the second direction and outwards away from the primary profile, for the secondary profile to firstly be coupled to the coupling legs in a tilted position, and then secondly be tilted towards the installed state while having an upper part of the secondary profile push the slanted downwards extending resilient elastically deformable retaining tabs to move out of the retaining position towards the passing position by resilient elastic deformation such that the upper part of the secondary profile is able to pass the retaining tabs, after which the retaining tabs spring back towards the retaining position causing the upper part of the secondary profile to get enclosed form-fitting by the retaining tabs together with the primary profile and the coupling legs.

11. A method for installing a ceiling suspension system according to claim 1, wherein the method comprises:

suspending the primary profile in the first direction using one or more suspension elements;

arranging one or more of said coupling brackets around the primary profile; and coupling the primary profile with the secondary profile using the coupling bracket, wherein the secondary profile firstly is coupled to the coupling legs, and then secondly is moved towards the installed state while pushing the retaining tabs to move out of their retaining position towards their passing position by resilient elastic deformation such that the secondary profile is able to pass the retaining tabs, after which the retaining tabs spring back towards their retaining position causing the secondary profile to get enclosed form-fitting by the retaining tabs together with the primary profile and the coupling legs, wherein the secondary profile firstly is coupled to the coupling legs in a tilted position, and then secondly is tilted towards the installed state while having an upper part of the secondary profile push the slanted downwards extending resilient elastically deformable retaining tabs to move out of the retaining position towards their passing position by resilient elastic deformation such that the upper part of the secondary profile is able to pass the retaining tabs, after which the retaining tabs spring back towards their retaining position causing the upper part of the secondary profile to get enclosed form-fitting by the retaining tabs together with the primary profile and the coupling legs.

12. The method according to claim 11, wherein the passing of the upper part of the secondary profile past by the resilient retaining tabs and the springing back of the resilient tabs to their retaining position is configured to cause an audible click sound.

* * * * *